US005190673A

United States Patent [19]

Leach

[11] Patent Number: 5,190,673

[45] Date of Patent: Mar. 2, 1993

[54] FILTRATION IN SOLVENT DEWAXING WITH CONTINUOUS SPRAYING OF FILTER WITH BOTH HOT AND COLD SOLVENTS

[75] Inventor: Lyle A. Leach, Morphett Vale Sth, Australia

[73] Assignee: Mobil Oil Corp., Fairfax, Va.

[21] Appl. No.: 714,430

[22] Filed: Jun. 12, 1991

[51] Int. Cl.[5] ..... C10G 73/06; C10G 73/10

[52] U.S. Cl. ..... 210/772; 208/33; 208/38; 210/784; 210/797

[58] Field of Search ..... 208/33, 38; 210/396, 210/402, 409, 784, 797, 772, 774; 26/791

[56] References Cited

U.S. PATENT DOCUMENTS

| | | | |
|---|---|---|---|
| 1,874,972 | 8/1932 | Hall | 210/772 |
| 2,040,056 | 5/1936 | Manley | 208/38 |
| 2,048,244 | 7/1936 | Bray et al. | 208/38 |
| 2,081,296 | 5/1937 | Gard | 210/784 |
| 3,791,525 | 2/1974 | Harris et al. | 210/217 |
| 4,820,400 | 4/1989 | Ryan et al. | 208/33 |

FOREIGN PATENT DOCUMENTS

| | | | |
|---|---|---|---|
| 63-36809 | 2/1988 | Japan | 210/791 |
| 2023641 | 1/1980 | United Kingdom | 208/33 |
| 8200029 | 1/1982 | World Int. Prop. O. | 208/38 |

OTHER PUBLICATIONS

Hobson, G. D. (ed.), Modern Petroleum Technology, 4th ed., pp. 427–429 (Date Unknown).

Hengstebeck, R. J., Petroleum Processing Principles and Applications, pp. 256–257 (1959).

*Primary Examiner*—Joseph W. Drodge

*Attorney, Agent, or Firm*—Alexander J. McKillop; Dennis P. Santini; Lori F. Cuomo

[57] ABSTRACT

An improved solvent dewaxing process in which a method and apparatus for continuous hot wash of a dewaxing filter is disclosed. A hot wash solvent is continuously sprayed below the doctor blade followed by a cold solvent spray below the hot solvent spray. Additionally, a solvent management process for changing the proportions of the solvent in response to different viscosity feedstocks thereby increasing filtration efficiency is also disclosed.

10 Claims, 2 Drawing Sheets

FILTRATION IN SOLVENT DEWAXING WITH CONTINUOUS SPRAYING OF FILTER WITH BOTH HOT AND COLD SOLVENTS

FIELD OF THE INVENTION

This invention relates to an improved process in which filter efficiency is increased in solvent dewaxing units. In particular, the invention provides a process for changing the proportions of the solvent and a method and apparatus for continuous filter hot wash.

BACKGROUND OF THE INVENTION

MEK(methyl ethyl ketone) dewaxing is the process most widely used. In MEK dewaxing, the wax bearing feed is mixed with solvent and the mixture is chilled to crystallize the wax. The chilled feed is then filtered continuously. Filtration is generally carried out in rotary drum filters. The filtration zone is at the bottom of the drum with cold wash solvent introduced at the top of the drum in the form of a spray to remove occluded filtrate.

The solvent used in the process usually contains from about 45 percent to about 75 percent MEK, with the remainder toluene. The concentration of MEK is different for each feedstock depending on the viscosity of the feed. The MEK component of the solvent induces wax precipitation while the toluene component maintains the oil in solution. MEK dewaxing is described in further detail in Hobson et al., *Modern Petroleum Technology* 427–429 (1975) and Hengstebeck, *Petroleum Processing Principles and Applications* 256–257 (1959).

Continuous filters are used in lube oil dewaxing. U.S. Pat. No. 3,791,525 to Harris et al. teaches a conventional rotary filter dewaxing apparatus.

The filtration rate generally declines as openings in the filter cloth plug up with small wax and ice particles, requiring periodic washing with hot solvent to remove the materials blocking the filter cloth. The filter must be taken off stream approximately every eight hours in order to wash with the hot solvent to restore the filter to the maximum filtration capacity.

No industrial dewaxing filters are known to be provided with continuous hot wash capability. Therefore, it is an object of the present invention to provide a method and apparatus for continuously applying a hot wash solvent to a dewaxing filter in order to increase production capacity.

The filterability of the wax is also dependent on the viscosity of the solution. Feed viscosity is different for each feedstock. A paraffin distillate has a different viscosity than a light motor oil. Therefore, it is a further object of the present invention to provide a method for changing proportions of the solvent when processing different viscosity feedstocks.

SUMMARY OF THE INVENTION

The present invention provides an improved solvent dewaxing process in which the filter efficiency is increased. In a first embodiment the invention relates to a method and apparatus for continuously applying hot wash solvent to a filter cloth Continuous operation of the filter would increase the production capacity of the dewaxing unit. The filter would not have to be taken out of service on a regular basis. Further, the filter would always be operating at the maximum possible filtration rate.

In a second embodiment the invention relates to a process for changing the proportions of the solvent when processing different viscosity feedstocks. The solvent composition if necessary can be changed as the feedstock is changed and thus maximum efficiency may be achieved over a wide range of operating conditions.

The invention therefore includes, in a first process aspect, a process for continuously applying hot wash solvent to a rotary drum filter having a doctor blade and filter cloth and used for lube oil dewaxing which comprises:

discharging wax at said doctor blade;

directing a spray of hot solvent below said doctor blade; and applying a cold solvent spray below said hot solvent spray to cool said filter cloth back to filtration temperature.

In its apparatus aspects the invention comprises a continuous filter apparatus for use in lube oil dewaxing said apparatus comprising:

a rotary drum filter, having a filter cloth;

a doctor blade engaging the filter cloth of said rotary drum filter;

an outlet for withdrawing wax at said doctor blade;

a conduit for directing a spray of hot solvent wash against the filter cloth below said doctor blade; and a conduit for applying a spray of cold solvent wash to the filter cloth below the hot solvent wash conduit.

The invention provides in a second process aspect a process for changing the composition of circulating solvent in an MEK dewaxing unit comprising the steps of:

subjecting a petroleum feedstock to solvent dewaxing and thereafter recovering solvent from both the dewaxed filtrate and the separated wax by evaporation and stripping;

dehydrating the recovered solvent to form a dry solvent and recycling said dry solvent to the dewaxing unit:

running a part of said dry solvent into a tank;

gradually splitting said dry solvent from the dry solvent tank into a MEK fraction and toluene fraction and storing each fraction in a separate tank; and replacing the solvent volume routed to the dry solvent tank with MEK recovered from the solvent splitter.

DETAILED DESCRIPTION OF THE INVENTION

Feedstocks useful for the present solvent dewaxing process include deasphalted vacuum resid and solvent extracted (furfural, N-methyl-2-pyrrolidone (NMP) or phenol) vacuum distillates.

The dewaxing solvent is preferably a mixture of MEK and toluene. Other suitable dewaxing solvents include, but are not limited to, methyl isobutyl ketone (MIBK), acetone and propane.

The particular operating conditions used in the present process will depend on the specific solvent, and will vary within the disclosed ranges depending upon the available feedstock and the desired lube oil quality.

Process conditions such as temperature, pressure, space velocity and molar ratio of reactants will affect the characteristics of the resulting lube oil, and may be adjusted within the disclosed ranges with only minimal trial and error by those skilled in the art.

TABLE 1

| PROCESS CONDITIONS | Broad | Preferred |
|---|---|---|
| Filtration temperature, °C. | −30 to −5 | −25 to −12 |
| Filtration pressure, psig | 0 to 5 | 1 to 3 |
| Wash solvent pressure, psig | 50 to 120 | 60 to 75 |
| Viscosity of feed (solvent free), Kinematic viscosity (KV), centipoise (CS) @ 100° C. | 2 to 35 | |

In a first embodiment the invention relates to a novel method and apparatus for continuously applying hot wash solvent to a dewaxing filter. The technique is based on applying hot solvent and cold solvent concurrently to the filter. The use of the hot wash solvent during filtration avoids the necessity of taking the filter out of service for approximately twenty minutes every eight hours to remove the materials that plug the filter cloth.

In the MEK process the waxes present in the oil feedstock are removed by mixing the feedstock with a dual solvent consisting of MEK and toluene, chilling the oil/solvent mixture and continuously filtering.

The solvent to feedstock ratio generally falls within the range of from about 1.7 to 3.0.

The filter employed in the present invention is a rotary drum filter. Rotary drum filters are described in detail in *Kirk-Othmer Encyclopedia Of Chemical Technology*, volume 10, p.314–318.

Figure 1:
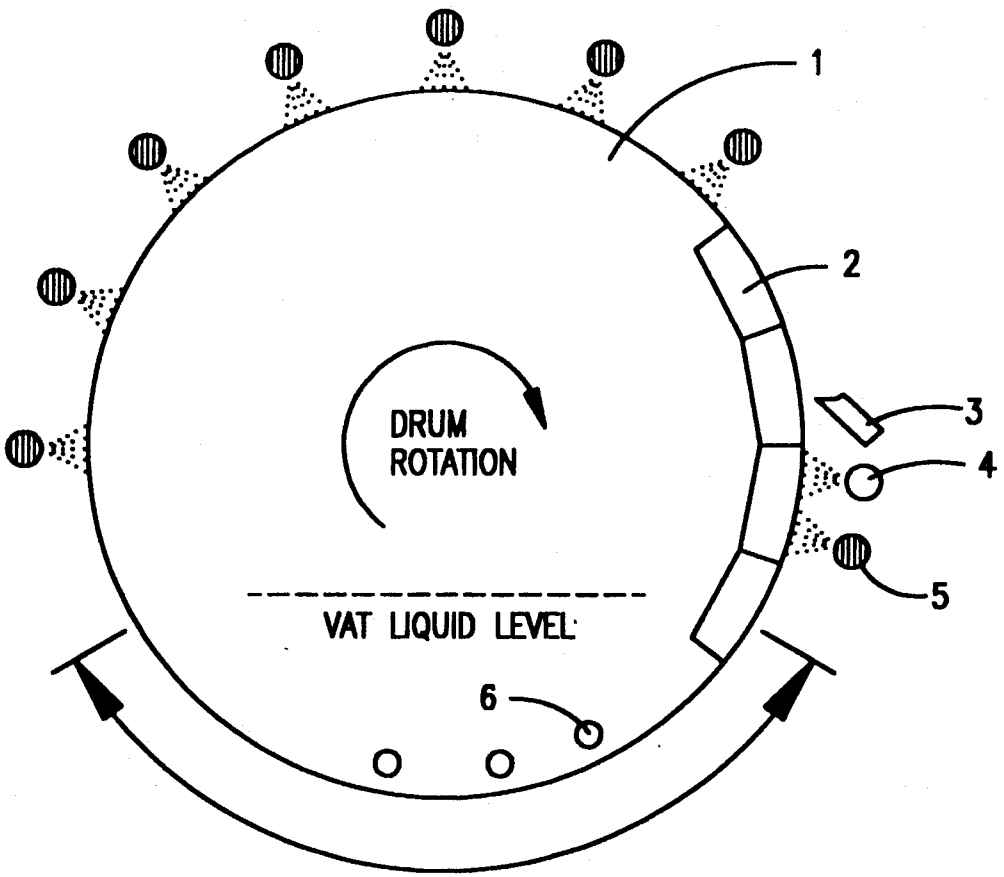
FIG. 1 is a simplified schematic diagram illustrating the filter apparatus of the present invention.

A schematic of the overall configuration of the filter apparatus is shown in FIG. 1. The oil/solvent mixture is continuously contacted in rotary drum 1 with cold wash solvent spray 5 and dewaxed oil is continuously discharged through port 6. Wax is discharged from the filter cloth 2 of rotary drum 1 at the doctor blade 3. Below the doctor blade the filter cloth 2 is subjected to a spray of hot wash solvent 4. Immediately following the hot wash solvent spray 4 a cold wash solvent spray 5 is applied to cool the filter cloth 2 back to the filtration temperature.

Cold wash solvent temperatures generally match filter feed temperatures, falling within the range of from about −30 ° to about −5° C. The temperature of the hot wash solvent typically falls within the range of from about 75° to about 85° C.

Continuous filter operation would increase production capacity of a dewaxing unit since the filter would not have to be taken out of service. The filter would always operate at the maximum possible filtration rate which would represent a 10–15% increase in production for filtration rate limited feeds.

The maximum MEK content of the solvent is different for each feedstock. In order to optimize operation for each stock, it is necessary to have the capability to remove water from the solvent, separate MEK from toluene, and control the composition of the solvent circulated within the process.

Figure 2:
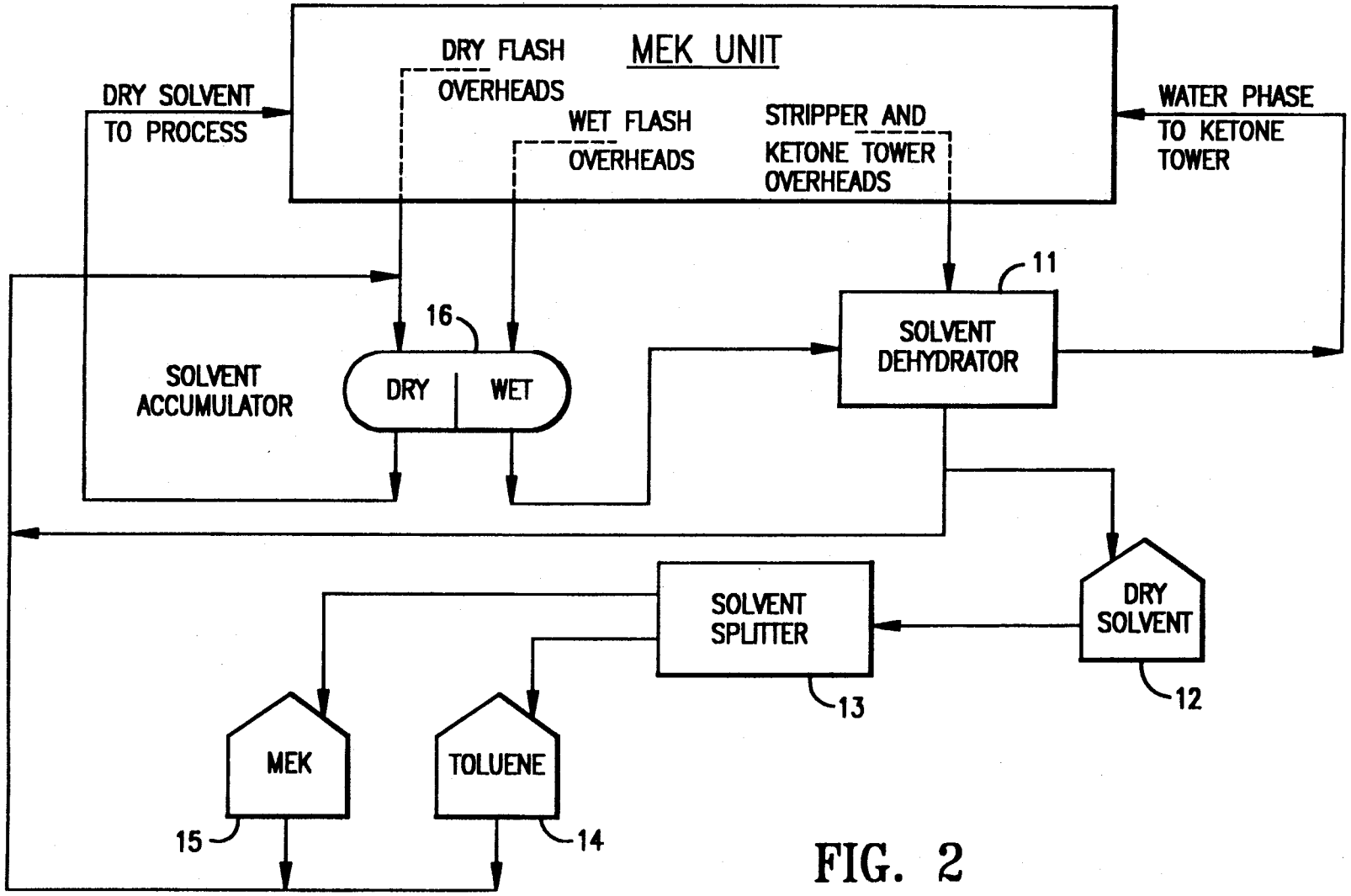
FIG. 2 is a simplified schematic diagram illustrating the solvent management process of the present invention.

A schematic of the overall configuration of the solvent management system is shown in FIG. 2. Solvent is continuously circulated through the MEK unit. The wet solvent recovered from the stripper and ketone tower overheads from the MEK unit is dehydrated in the solvent dehydrator 11. When it is desired to change the concentration of the solvent in the unit, part of the dry solvent is run into a the dry solvent tank 12. The solvent from the dry solvent tank is routed to the solvent splitter 13 where it is split into relatively pure MEK and toluene streams and stored in the MEK tank 15 and the toluene tank 14, respectively. The solvent volume routed to the dry solvent tank is replaced with MEK from the MEK tank and sent to the dry solvent accumulator 16 for use in the MEK dewaxing process. This effects a rapid change in the solvent inventory composition.

The filter feed viscosity can be reduced by increasing the percentage of MEK in the solvent thereby increasing the filtration rate. For example, the percentage of MEK in the circulating solvent can be changed from 60% MEK to 70% MEK, a about 4 to about 8 hours.

Another advantage of increasing the percentage of MEK is operation at higher filter feed temperatures which further increases filtration rate by reducing liquid viscosity. A further advantage of higher filter feed temperatures is the use of less refrigeration, thereby increasing unit capacity.

Another advantage of storing dry solvent in a tank followed by the gradual splitting of the solvent is the maximization of MEK unit throughput with minimum investment. Alternatively, a large solvent splitter could be used. However, the large solvent splitter would require a more substantial capital investment and only be in service a few hours a week. Another alternative, slowly changing the solvent composition, would not allow maximum operating time at the optimum solvent concentration.

Changes and modifications in the specifically described embodiments can be carried out without departing from the scope of the invention which is intended to be limited only by the scope of the appended claims.

What is claimed is:

1. A process for continuously applying hot wash solvent to a rotary drum filter used for solvent dewaxing and operated at a filtration temperature in the range of from about −30 ° to about −5° C., said rotary drum filter having a doctor blade and a filter cloth, the improvement which comprises:

discharging wax at said doctor blade;

continuously directing a spray of hot solvent below said doctor blade of said rotary drum filter, said hot solvent having a temperature in the range of from about 75° to about 85° C.;

continuously directing a cold solvent spray below said hot solvent spray to cool said filter cloth back to the filtration temperature, wherein said cold solvent spray is at about the filtration temperature.

2. The process of claim 1 wherein both said hot solvent and said cold solvent comprises MEK.

3. The process of claim 1 wherein said solvent dewaxing is lube oil solvent dewaxing.

4. The process of claim 1 wherein both said hot solvent and said cold solvent comprises toluene.

5. The process of claim 1 wherein said hot solvent and said cold solvent are sprayed concurrently.

6. The process of claim 1 wherein said filtration temperature is in the range of from about −25° to about −12° C.

7. The process of claim 1 wherein both said hot solvent spray and said cold solvent spray are at a pressure in the range of from about 50 to about 120 psig.

8. The process of claim 7 wherein said hot solvent spray and said cold solvent spray are at a pressure in the range of from about 60 to about 75 psig.

9. The process of claim 1 wherein said filtration pressure is in the range of from about 0 to about 5 psig.

10. The process of claim 9 wherein said filtration pressure is in the range of from about 1 to about 3 psig.

* * * * *